US008068774B2

(12) United States Patent
Mori et al.

(10) Patent No.: US 8,068,774 B2
(45) Date of Patent: Nov. 29, 2011

(54) IMAGE-FORMING APPARATUS EQUIPPED WITH SPECIFIED INTERMEDIATE TRANSFER MEMBER

(75) Inventors: Tomohide Mori, Okazaki (JP); Yasuyuki Inada, Toyokawa (JP); Toshiaki Hiroi, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 838 days.

(21) Appl. No.: 12/081,209

(22) Filed: Apr. 11, 2008

(65) Prior Publication Data

US 2008/0304877 A1 Dec. 11, 2008

(30) Foreign Application Priority Data

Jun. 8, 2007 (JP) ..... 2007-152337

(51) Int. Cl.
*G03G 15/01* (2006.01)

(52) U.S. Cl. ..... 399/302

(58) Field of Classification Search ..... None
See application file for complete search history.

(56) References Cited

U.S. PATENT DOCUMENTS

| | | | | |
|---|---|---|---|---|
| 5,600,420 | A * | 2/1997 | Saito et al. | 399/302 |
| 5,761,594 | A | 6/1998 | Seto et al. | |
| 2006/0275570 | A1 | 12/2006 | Egawa | |
| 2008/0032222 | A1 * | 2/2008 | Stelter et al. | 430/105 |
| 2009/0041514 | A1 | 2/2009 | Maehara | |
| 2009/0129829 | A1 * | 5/2009 | Saito | 399/308 |

FOREIGN PATENT DOCUMENTS

| | | | |
|---|---|---|---|
| JP | 8-211755 | A | 8/1996 |
| JP | 2003-107927 | | 4/2003 |
| JP | 2005-250137 | | 9/2005 |
| JP | 2005-352007 | | 12/2005 |
| JP | 2007-011311 | | 1/2007 |
| JP | 2007-114277 | | 5/2007 |
| WO | WO/2006/012954 | * | 12/2006 |
| WO | WO 2007/046218 | | 4/2007 |

OTHER PUBLICATIONS

European Search Report in Application No. 08010033.2-2209, dated Oct. 24, 2008.

Notification of Reasons for Refusal in JP 2007-152337 dated May 26, 2009, and an English Translation thereof.

* cited by examiner

*Primary Examiner* — David Porta
*Assistant Examiner* — Carolyn Igyarto
(74) *Attorney, Agent, or Firm* — Buchanan Ingersoll & Rooney, P.C.

(57) ABSTRACT

An image-forming apparatus comprises an intermediate transfer member having a hard release layer on the surface that receives a primarily transferred toner image from a latent image-supporting member on the hard release layer and secondarily transfers the toner image to an image-receiving medium, wherein, when the difference Δγsd between the dispersion-force component of surface free energy of the intermediate transfer member surface γsd(itm) and the dispersion-force component of surface free energy of the latent image-supporting member surface γsd(pc) is defined by the following Formula:

$$\Delta\gamma sd=\gamma sd(pc)-\gamma sd(itm),$$

Δγsd is 5 mN/m or less.

19 Claims, 2 Drawing Sheets

IMAGE-FORMING APPARATUS EQUIPPED WITH SPECIFIED INTERMEDIATE TRANSFER MEMBER

This application is based on application(s) No. 2007-152337 filed in Japan, the contents of which are hereby incorporated by reference.

BACKGROUND OF THE INVENTION

1. Field of the Invention

The present invention relates to image-forming apparatuses such as monochromic/full-color copying machine, printer, facsimile machine and multifunctional processing machine.

2. Description of the Related Art

In an image-forming apparatus in intermediate transfer mode, toner images in various colors formed on a latent image-supporting member are respectively primarily transferred to and superimposed on an intermediate transfer member, and the superimposed image is secondarily transferred collectively onto an image-receiving medium. In such an image-forming apparatus, there remains a small amount of toner on the intermediate transfer member after the secondary transfer.

Formation of a hard release layer on the surface of the intermediate transfer member for improvement of the secondary transfer rate may be effective in improving the toner release characteristics. However, there may be some improvement in secondary transfer efficiency in such an image-forming apparatus, but, during primary transfer of the toner image formed on the latent image-supporting member onto the intermediate transfer member, the toner image is held and pressurized between the latent image-supporting member and the intermediate transfer member, giving other new problems such as aggregation of toner and hollow defects of the resulting image. Specifically, the hard release layer on the intermediate transfer member surface is formed for easier release of the toner, and a part of the toner aggregate formed by pressurization during primary transfer adheres to and remains more on the latent image-supporting member than on the intermediate transfer member higher in release characteristics, thus prohibiting primary transfer. The hollow defects become more distinctive, particularly in the central area of a character or thin line image where the pressure and thus the toner aggregation force are higher.

BRIEF SUMMARY OF THE INVENTION

An object of the present invention is to provide an image-forming apparatus capable of preventing hollow defects even when an intermediate transfer member having a hard release layer on the surface is used.

The present invention relates to an image-forming apparatus, comprising an intermediate transfer member having a hard release layer on the surface that receives a primarily transferred toner image from a latent image-supporting member on the hard release layer and secondarily transfers the toner image to an image-receiving medium, wherein, when the difference Δγsd between the dispersion-force component of surface free energy of the intermediate transfer member surface γsd(itm) and the dispersion-force component of surface free energy of the latent image-supporting member surface γsd(pc) is defined by the following Formula:

$$\Delta\gamma sd=\gamma sd(pc)-\gamma sd(itm),$$

Δγsd is 5 mN/m or less.

DETAILED DESCRIPTION OF THE INVENTION

The present invention provides an image-forming apparatus, comprising an intermediate transfer member having a hard release layer on the surface that receives a primarily transferred toner image from a latent image-supporting member on the hard release layer and secondarily transfers the toner image to an image-receiving medium, wherein, when the difference Δγsd between the dispersion-force component of surface free energy of the intermediate transfer member surface γsd(itm) and the dispersion-force component of surface free energy of the latent image-supporting member surface γsd(pc) is defined by the following Formula:

$$\Delta\gamma sd=\gamma sd(pc)-\gamma sd(itm),$$

Δγsd is 5 mN/m or less.

The image-forming apparatus according to the present invention prevents hollow defects in printed image, even when an intermediate transfer member having a hard release layer higher in release characteristics on the surface is used for improvement of secondary transfer rate and image quality. In addition, the cleaning efficiency is improved, when the dispersion-force component of surface free energy of the intermediate transfer member surface γsd(itm) is adjusted in a particular range.

The image-forming apparatus according to the present invention has an intermediate transfer member for holding a toner image primarily transferred from a latent image-supporting member and secondarily transferring the held toner image to an image-receiving medium. The image-forming apparatus according to the present invention will be described below, by taking a tandem full-color image-forming apparatus having latent image-supporting members for respective development units forming toner images in various colors on the latent image-supporting member as an example, but may be an apparatus in the other structure, for example, a four-cycle full-color image-forming apparatus having development units in various colors for one latent image-supporting member.

Figure 1:
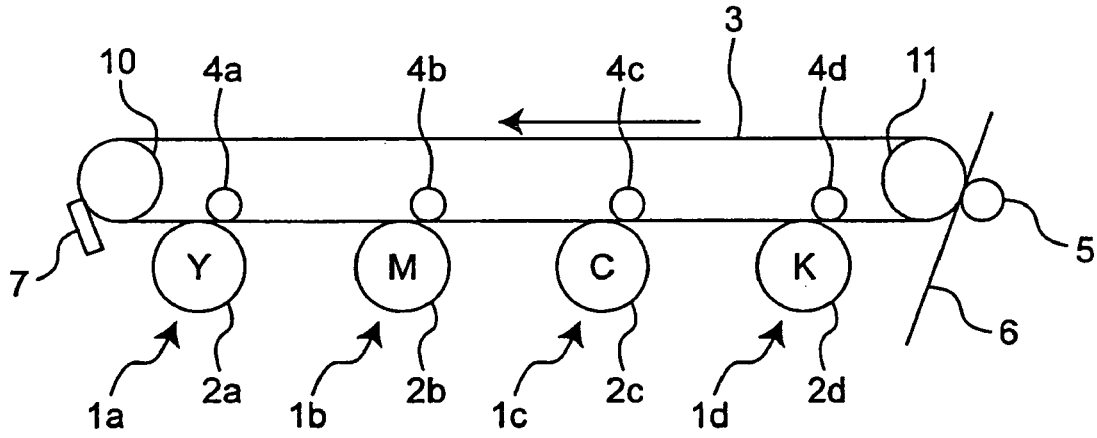
FIG. 1 is a schematic view illustrating configuration of an example of an image-forming apparatus according to the present invention.

FIG. 1 is a schematic view illustrating the configuration of an example of the image-forming apparatus according to the present invention. Each development unit (1*a*, 1*b*, 1*c*, or 1*d*) in the tandem full-color image-forming apparatus shown in FIG. 1 has normally at least an electrostatically charging device, an exposure device, a developing device and a cleaning device (no device shown in Figure) around the latent image-supporting member (2*a*, 2*b*, 2*c*, or 2*d*). The development units (1*a*, 1*b*, 1*c*, and 1*d*) are installed in parallel with an intermediate transfer member 3 stretched by at least two stretching rollers (10 and 11). The toner image formed on the surface of the latent image-supporting member (2*a*, 2*b*, 2*c*, or 2*d*) in each development unit is primarily transferred onto the intermediate transfer member 3 by a primary transfer roller (4*a*, 4*b*, 4*c*, or 4*d*) and superimposed on the intermediate transfer member, forming a full-color image. The full-color image transferred on the surface of the intermediate transfer member 3 is secondarily transferred onto an image-receiving medium 6 such as paper collectively by a secondary transfer roller 5, and a full-color image is formed on the image-receiving medium during passage of the medium through a fixing device (not shown in Figure). On the other hand, the resilient toner remaining on the intermediate transfer member is removed by a cleaning device 7.

The latent image-supporting member (2*a*, 2*b*, 2*c*, or 2*d*) is a so-called photosensitive member on which a toner image is formed, based on the electrostatic latent image formed on the surface. The latent image-supporting member is not particularly limited, if there is a difference described below between its dispersion-force component γsd(pc) of the surface free energy and the dispersion-force component γsd(itm) of surface free energy of the intermediate transfer member surface, and thus, for example, the photosensitive layer may be organic or inorganic. The latent image-supporting member normally has a γsd(pc) of 30 to 45 mN/m, particularly preferably 32 to 42 mN/m.

γsd(pc) can be controlled, for example, by coating a fatty acid metal salt on the surface of the latent image-supporting member, adjusting the coating amount thereof, or dispersing PTFE-resin fine particles in the surface layer.

For example, application of a fatty acid metal salt leads to decrease of γsd(pc).

For example, increase in the amount of the fatty acid metal salt leads to decrease of γsd(pc), while decrease in the coating amount, to increase of γsd(pc).

Alternatively, for example, dispersion of PTFE fine particles in the latent image-supporting member surface layer leads to decrease of γsd(pc). Increase of PTFE particle amount leads to decrease of γsd(pc), and vice versa.

γsd(pc) is the dispersion-force component of surface free energy of the latent image-supporting member surface, and a value obtained by the following method is used. The contact angle to the latent image-supporting member surface is determined in a full automatic contact angle meter (CA-W150; manufactured by Kyowa Interface Science Co., Ltd.) by droplet method by using pure water, methylene chloride and 1-bromonaphthalene as liquid samples. The surface free energy γsd is obtained according to the expanded Fowkes equation, by using surface-free-energy analysis software (EG-11; available from Kyowa Interface Science Co., Ltd.).

In the present invention, the intermediate transfer member 3 has a hard release layer on the surface, and, when the difference Δγsd between the dispersion-force component γsd (itm) of the surface free energy and the γsd(pc) above is expressed by the following Formula:

$$\Delta\gamma sd=\gamma sd(pc)-\gamma sd(itm),$$

Δγsd is 5 mN/m or less. For further improvement of the toner release characteristics of the intermediate transfer member and prevention of hollow defects during primary transfer, Δγsd is preferably in the range of −15 to 5 mN/m, particularly preferably −10 to 4 mN/m. By making the Δγsd in the range above, it is possible to prevent hollow defects in printed image effectively even when an intermediate transfer member having a hard release layer is used. The surface free energy is often discussed generally with the sum γs of dispersion-force component γsd, dipolar force component γsp, and hydrogen-bonding component γsh; for example, when an intermediate transfer member having on the surface a layer higher in release characteristics to toner is used, if the sum of surface free energy γs, $$\Delta\gamma s=\gamma s(pc)-\gamma s(itm)$$

(wherein, γs(pc) is the sum of the surface free energy of latent image-supporting member, and γs(itm), the sum of surface free energy on the intermediate transfer member) is smaller, the hollow defects seldom occur theoretically; but in practice, the hollow defects occur even when Δγs is relatively small. In the present invention, it is possible, by making the difference Δγsd in the dispersion-force component of surface free energy in the range above, to prevent hollow defects in printed images effectively even when an intermediate transfer member having a hard release layer is used.

The phenomenon of the hollow defects being prevented by specifying Δγsd was not clearly understood, but became more evident by the test described below. The balance between the release characteristics of the latent image-supporting member surface and the intermediate transfer member surface toward the toner, i.e., the balance of the interaction of the toner with respective surfaces, exerts influence on hollow defects. Toners generally made of a resin have suitable physical properties including electrostatic properties, but the experiments described below showed that the interaction between such a toner and respective surfaces correlated well with Δγsd but not with Δγs.

γsd(itm) is not particularly limited as long as Δγsd is in the range above, and normally 30 to 50 mN/m, preferably 35 to 45 mN/m, and more preferably 37 to 45 mN/m. A γsd(itm) of 37 mN/m or more leads to increase of the cleaning efficiency of the intermediate transfer member. An excessively large γsd (itm) enhances compatibility between the intermediate transfer member and the cleaning blade (in particular, of polyurethane rubber) and leads to relative increase in the friction force between them.

For example, when a hard release layer is formed by plasma CVD described below, γsd(itm) becomes smaller when the feed rate of raw materials during application is decreased, while it becomes greater when the feed rate is increased.

γsd(itm) also becomes smaller, for example, when fluorine coating is performed on the surface of the hard release layer. When a coating solution containing fluorine is used for the fluorine coating, γsd(itm) can be adjusted by controlling a concentration of the coating solution, and increase in the concentration of coating solution leads to decrease of γsd (itm).

γsd(itm) is the dispersion-force component of surface free energy of the intermediate transfer member surface, and is determined according a method similar to γsd(pc), except that the contact angel on the intermediate transfer member surface is measured.

An intermediate transfer belt is shown as the intermediate transfer member 3 in FIG. 1, but the intermediate transfer member is not limited thereto, and may be, for example, a so-called intermediate transfer drum.

Figure 2:
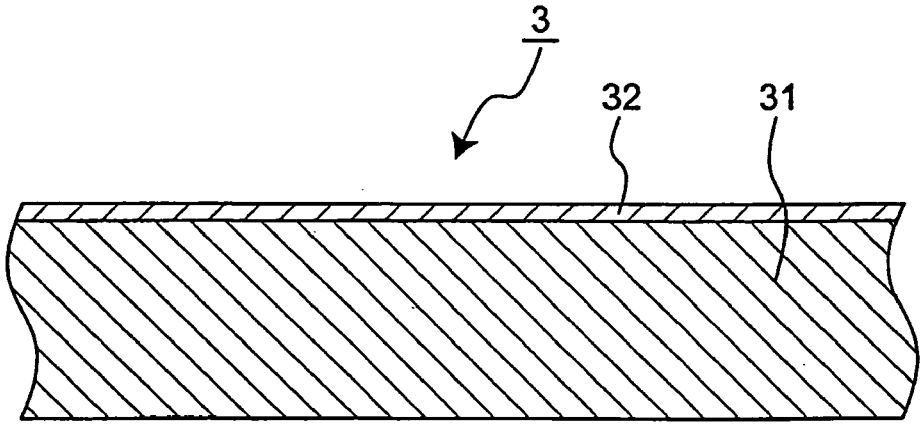
FIG. 2 is a schematic sectional view illustrating layer structure of an intermediate transfer member.

The intermediate transfer member according to the present invention will be described, by taking the case where the intermediate transfer member 3 is a seamless belt as an example. FIG. 2 is a conceptual sectional view illustrating the layer structure of the intermediate transfer belt 3.

The intermediate transfer belt 3 has at least a substrate 31 and a hard release layer 32 formed on the surface of the substrate 31.

The substrate 31 is not particularly limited, but is a seamless belt having a surface resistivity at the order of $10^6$ to $10^{12}\Omega/\square$; and examples thereof include resin materials including polycarbonate (PC), polyimide (PI), polyphenylene sulfide (PPS), polyamide-imide (PAI), fluorine resins such as polyvinylidene fluoride (PVDF), tetrafluoroethylene-ethylene copolymers (ETFEs), urethane resins such as polyurethane, poly-amide resins such as polyamide-imide, and the like; and also, rubber materials, such as ethylene-propylene-diene rubber (EPDM), nitrile-butadiene rubber (NBR), chloroprene rubber (CR), silicone rubber, polyurethane rubber and the like, containing a conductive filler such as carbon or an ionic conductive material dispersed therein. The thickness of the substrate is normally approximately 50 to 200 μm in the case of a resin material and approximately 300 to 700 μm in the case of a rubber material.

The intermediate transfer belt 3 may have an additional layer between the substrate 31 and the hard release layer 32, but the hard release layer 32 is positioned to be an outermost layer.

The substrate 31 may be surface-treated previously by a known surface-treatment method, for example by plasma, flame, UV irradiation, or the like, before lamination with the hard release layer 32.

The hard release layer 32 is a hard layer having release characteristics to the toner, and the dispersion-force component of surface free energy γsd(itm) of the surface has the difference described above from the dispersion-force component of surface free energy γsd(pc) of the latent image-supporting member surface. Typical examples of the hard release layer 32 include inorganic oxide layers, hard carbon-containing layers and the like. The hardness of the hard release layer 32 is normally 3 GPa or more, particularly 3 to 11 GPa.

The hardness in the present description is a hardness as determined by nanoindentation method, for example, by using NANO Indenter XP/DCM (manufactured by MTS Systems Corporation and MTS NANO Instruments).

As described above, the surface free energy is usually discussed with the sum γs of γsd, γsh and γsp, but, in the present invention, the inventors have found, by focusing on γsd, a condition in which it is possible to prevent hollow defects of printed image more favorably and effectively. When γsh is a large value, such as in the range of 25-35 mN/m, as when an inorganic oxide is used as the material for the hard release layer on the surface of the intermediate transfer member, there is particularly smaller correlation between Δγs and hollow defect characteristics, and thus, it is not possible to obtain a condition suitable for the surface free energies of the latent image-supporting member surface and the intermediate transfer member surface. For that reason, the present invention is particularly effective, when γsh is in the range above.

γsh (itm) is determined by a method similar to that for γsd(itm).

The inorganic oxide layer is preferably a layer having a thickness of 10 to 1,000 nm and containing at least one oxide selected from $SiO_2$, $Al_2O_3$, $ZrO_2$, and $TiO_2$, particularly preferably $SiO_2$. The inorganic oxide layer is preferably formed by plasma CVD of converting a mixed gas containing at least a discharge gas and a raw gas for inorganic oxide layer into plasma state and depositing the film corresponding to the raw gas, in particular by plasma CVD carried out under atmospheric pressure or a pressure close thereto.

Hereinafter, the production apparatus and the production method will be described, by taking the case when an inorganic oxide layer is produced by using silicon oxide ($SiO_2$) by plasma CVD under atmospheric pressure as an example. The atmospheric pressure or a pressure close thereto is about 20 to 110 kPa, and a pressure of 93 to 104 kPa is preferable, for obtaining the favorable effects of the present invention.

Figure 3:
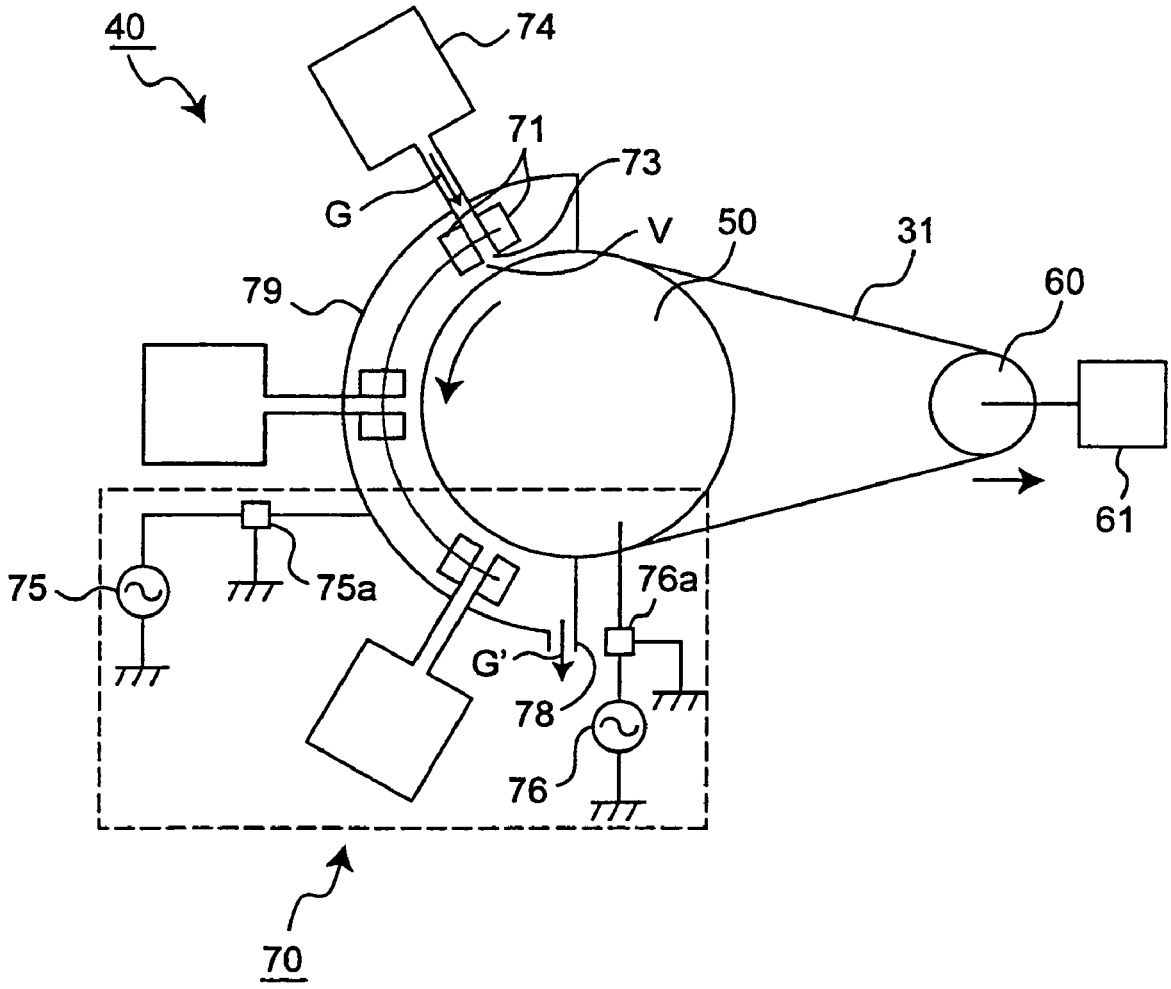
FIG. 3 is a view illustrating an apparatus producing an intermediate transfer member.

FIG. 3 is a view illustrating the production apparatus for forming an inorganic oxide layer. The apparatus for producing an inorganic oxide layer 40 is an apparatus forming an inorganic oxide layer on a substrate in the direct mode of depositing and forming a film by exposing the substrate to plasma almost in the same unit that has a discharge space and a thin film-depositing region, and has a roll electrode 50 revolving in the arrow direction carrying an endless belt-shaped substrate 31 wound around it, a follower roller 60, and an atmospheric-pressure plasma CVD apparatus 70, i.e., a film-forming apparatus forming an inorganic oxide layer on the substrate surface.

The atmospheric-pressure plasma CVD apparatus 70 has at least one set of a fixed electrode 71, a discharge space 73 allowing discharge in the region of the fixed electrode 71 and the roll electrode 50 facing each other, a mixed gas-supplying apparatus 74 generating a mixed gas G at least containing a raw gas and a discharge gas and supplying the mixed gas G into the discharge space 73, a discharge container 79 restricting the flow of air for example into the discharge space 73, a first power source 75 connected to the fixed electrode 71, a second power source 76 connected to the roll electrode 50, and an exhaust unit 78 discharging the used exhaust gas G', that are placed along the external surface of the roll electrode 50. The second power source 76 may be connected to the fixed electrode 71, and the first power source 75 to the roll electrode 50.

The mixed-gas-supplying apparatus 74 supplies a mixed gas of a raw gas for forming a film containing silicon oxide and a rare gas such as nitrogen or argon to the discharge space 73.

The follower roller 60 applies a particular tension to the substrate 31, as it is pulled by the tension-applying means 61 in the arrow direction. The tension-applying means 61 eliminates application of tension, for example, during exchange of the substrate 31, allowing easy exchange of the substrate 31.

The first power source 75 output a voltage at a frequency of ω1, while the second power source 76, a voltage at a frequency of ω2 higher than ω1, together generating an electric field V by superimposing these voltages at frequencies of ω1 and ω2 in the discharge space 73. The mixed gas G is turned into plasma by the electric field V, and a film (inorganic oxide layer) corresponding to the raw gas contained in the mixed gas G is deposited on the surface of the substrate 31.

Alternatively, the roll electrode 50 or the fixed electrode 71 may be grounded, and the other connected to a power source. In such a case, a second power source is favorably used as the power source, especially when a rare gas such as argon is used as the discharge gas, because a dense thin film is formed.

The inorganic oxide layers are deposited as piled, while the thickness of the inorganic oxide layer is adjusted, by multiple fixed electrodes and mixed-gas-supplying apparatuses located downstream in the rotation direction of the roll electrode among multiple fixed electrodes.

An inorganic oxide layer is deposited by the fixed electrode and the mixed-gas-supplying apparatus located most downstream in the rotation direction of the roll electrode among multiple fixed electrodes, and the other layers such as an adhesive layer for improving the adhesion between the inorganic oxide layer and the substrate may be formed by other fixed electrodes and mixed-gas-supplying apparatuses located upstream.

For improvement in adhesion between the inorganic oxide layer and the substrate, a gas-supplying apparatus supplying a gas such as argon, oxygen or hydrogen and a fixed electrode may be formed at positions upstream of the fixed electrode forming an inorganic oxide layer and the mixed-gas-supplying apparatus for plasma treatment and activation of the surface of the substrate.

Typical examples of the hard carbon-containing layer as a hard release layer 32 include amorphous carbon film, hydrogenated amorphous carbon film, tetrahedral amorphous carbon film, nitrogen-containing amorphous carbon film, metal-containing amorphous carbon film, and the like. The thickness of the hard carbon-containing layer is preferably similar to that of the inorganic oxide layer.

The hard carbon-containing layer may be prepared by a method similar to that for preparation of the inorganic oxide layer, for example, by plasma CVD of turning at least a mixed gas of a discharge gas and a raw gas to plasma and forming a film corresponding to the raw gas by deposition, especially by plasma CVD carried out under atmospheric pressure or a pressure close thereto.

An organic compound gas, particularly a hydrocarbon gas, which is gaseous or liquid at room temperature, is used as a raw gas for forming a hard carbon-containing layer. The raw material may not be gaseous under normal temperature and normal pressure, and a raw material in the liquid or solid phase may be used instead, if it can be vaporized for example by melting, vaporization, or sublimation by heating or under reduced pressure in the mixed-gas-supplying apparatus. The raw hydrocarbon gas for use is, for example, a gas containing at least a hydrocarbon such as a paraffin hydrocarbon such as $CH_4$, $C_2H_6$, $C_3H_8$, or $C_4H_{10}$; an acetylene-based hydrocarbon such as $C_2H_2$ or $C_2H_4$, an olefinic hydrocarbon, a diolefinic hydrocarbon, or an aromatic hydrocarbon. Compounds other than hydrocarbons at least containing carbon such as alcohols, ketones, ethers, esters, CO, and $CO_2$ are also usable.

The intermediate transfer member 3 and the latent image-supporting member 2 form a nip region (contact area); as a result, the intermediate transfer member 3 presses the latent image-supporting member 2; and thus, when a particular voltage is applied to the primary transfer rollers 4 (4*a*, 4*b*, 4*c*, and 4*d*), the toner image on the latent image-supporting member is transferred onto the surface of the intermediate transfer member.

The cleaning device 7 is not particularly limited, if the toner remaining on the surface of the intermediate transfer member can be removed, and examples thereof include cleaning blade, cleaning brush, and the like, and a cleaning blade is preferable.

The cleaning blade may be made of any material, and an example thereof is polyurethane rubber. When used in combination with the intermediate transfer member in the present invention, the cleaning blade is preferably made of polyurethane rubber.

Other parts and devices in the image-forming apparatus according to the present invention, such as primary transfer rollers 4 (4*a*, 4*b*, 4*c*, 4*d*), secondary transfer roller 5, stretching rollers (10,11), electrostatically charging device, exposure device, and developing device and cleaning device for latent image-supporting member, are not particularly limited, and those traditionally used in image-forming apparatuses may be used.

For example, the developing device may be a mono-component developing system by using only a toner or a two-component developing system by using a toner and a carrier.

The toner may contain toner particles prepared by wet method such as polymerization method or toner particles prepared by pulverization method (dry method).

The average particle size of the toner is not particularly limited, but preferably 7 μm or less, particularly preferably 4.5 to 6.5 μm. The average circularity of the toner is preferably 0.910 to 0.985, particularly preferably 0.960 to 0.980. Decrease in toner average particle size or decrease in average circularity results in easier hollow defects, but in the present invention, it is possible to prevent hollow defects effectively even when a toner having such a particle diameter and an average circularity is used.

The toner average particle size is a value determined by using an Espert analyzer (manufactured by Hosokawa Micron Corporation).

The toner average circularity is a value determined by using FPIA-1000 (manufactured by To a Medical Electronics).

EXAMPLES

Preparation of Transfer Belt A

A seamless substrate containing carbon dispersed in a PPS resin and having a surface resistivity of $1\times10_9\Omega/\square$ and a thickness of 0.15 mm was prepared by extrusion molding.

A $SiO_2$ thin film layer having a film thickness of 500 nm (hardness: 4 GPa) was formed on the external surface of the substrate by atmospheric-pressure plasma CVD, to give a transfer belt A.

Preparation of Transfer Belt B

A transfer belt B was prepared in a similar manner to the transfer belt A, except that the raw gas feed rate during film formation by plasma CVD was reduced by 5%. The thickness of the thin film layer obtained was 400 nm, and the hardness, 3.8 GPa.

Preparation of Transfer Belt C

A transfer belt C was prepared in a similar manner to the transfer belt A, except that the raw gas feed rate during film formation by plasma CVD was reduced by 15%. The thickness of the thin film layer obtained was 300 nm, and the hardness, 3.5 GPa.

Preparation of Transfer Belt D

A transfer belt D was prepared in a similar manner to the transfer belt A, except that the raw gas feed rate during film formation by plasma CVD was reduced by 20%. The thickness of the thin film layer obtained was 250 nm, and the hardness, 3.5 GPa.

Preparation of Transfer Belt E

A transfer belt E was prepared in a similar manner to the transfer belt A, except that the $SiO_2$ thin film layer was dip-coated with a solution containing a coating agent "Optool DSX" (manufactured by Daikin Industries, Ltd) diluted in "SoL-1" (manufactured by the same company) to 0.15 wt % and dried. The thickness of the thin film layer obtained was 500 nm, and the hardness, 4 GPa.

Preparation of Transfer Belt F

A transfer belt F was prepared in a similar manner to the transfer belt E, except that the coating agent was diluted to 0.10 wt %. The thickness of the thin film layer obtained was 500 nm, and the hardness, 4 GPa.

Preparation of Transfer Belt G

A transfer belt G was prepared in a similar manner to the transfer belt E, except that the coating agent was diluted to 0.18 wt %. The thickness of the thin film layer obtained was 500 nm, and the hardness, 4 GPa.

Preparation of Transfer Belt H

A transfer belt H was prepared in a similar manner to the transfer belt E, except that the coating agent was diluted to 0.20 wt %. The thickness of the thin film layer obtained was 500 nm, and the hardness, 4 GPa.

Preparation of Transfer Belt I

A transfer belt I was prepared in a similar manner to the transfer belt A, except that the raw gas feed rate was reduced by 30%. The thickness of the thin film layer obtained was 200 nm, and the hardness, 3.3 GPa.

Preparation of Transfer Belt J

A transfer belt J was prepared in a similar manner to the transfer belt E, except that the coating agent was diluted to 0.25 wt %. The thickness of the thin film layer obtained was 500 nm, and the hardness, 4 GPa.

(Preparation of Photosensitive Member A)

The outmost layer of a photosensitive member for color MFP Bizhub C352 (manufactured by Konica Minolta Holdings, Inc.) was coated with a polycarbonate resin (Iupilon Z-300; manufactured by Mitsubishi Gas Chemical Company, Inc.) containing dispersed PTFE resin particles (NS-06; manufactured by Nagoya Gosei Kagaku Co., Ltd), to give a photosensitive member A.

(Preparation of Photosensitive Member B)

A photosensitive member B was prepared in a similar manner to the photosensitive member A, except that the outmost layer was formed with a polycarbonate resin (Iupilon Z-300; manufactured by Mitsubishi Gas Chemical Company, Inc.) containing dispersed alumina particles.

(Preparation of Photosensitive Member C)

The surface of a photosensitive member for color MFP Bizhub C352 (manufactured by Konica Minolta Holdings, Inc.) was coated with a fatty acid metal salt (zinc stearate), to give a photosensitive member C.

The sum of the surface free energies γs, the dispersion-force component γsd and the hydrogen-bonding component γsh of each of the transfer belts (itm) and the photosensitive bodies (pc) obtained were determined by the methods described above.

Evaluation

Hollow Defects

A transfer belt and a photosensitive member, obtained above, were installed in a color printer MFP BizhubC352 (manufactured by Konica Minolta Holdings, Inc.) as shown in FIG. 1; a thin line image was printed under a high-temperature high-humidity (HH) environment at 30° C. and 85% RH; and hollow defects in the printed image were evaluated. The toner used was a polymerization toner having an average particle size of 6.5 μm and an average circularity of 0.950. The cleaning blade used was a polyurethane rubber blade having an impact resilience of 38% and a Young's modulus of 6.4 MPa at 25° C., and, as shown in FIG. 1, it was used as pressed to the transfer belt 3 at a pressure of 30 N/m in the direction opposite to the traveling direction of the transfer belt 3.

○: No hollow defects observed;

x: Hollow defects observed.

Cleaning Efficiency 1,000 sheets were printed at a printing rate of 100% under a low-temperature low-humidity (LL) environment at 10° C. and 15% RH; the printed images was evaluated in a manner similar to the evaluation method for hollow defects, except that the cleaning efficiency was evaluated.

○; No linear image noise caused by insufficient cleaning observed.

x; Linear image noise caused by insufficient cleaning observed.

(Test Method)

The impact resilience at 25° C. was determined by a method in accordance with JIS-$K_{6255}$.

The Young's modulus was determined according to JIS-K6254 at an elongation of 25%.

TABLE 1

| Example/ Comparative Example | Kind of transfer belt (γsh(itm); mN/m) | Kind of photosensitive member | γ sd(mN/m) γ sd(itm) | γ sd(pc) | Δ γ sd | γ s(mN/m) γ s(itm) | γ s(pc) | Δ γ s | Hollow defects | Cleaning efficiency |
|---|---|---|---|---|---|---|---|---|---|---|
| Example 1 | A (30.6) | A | 40.9 | 33.9 | −7 | 71.3 | 34.1 | −37.2 | ○ | ○ |
| Example 2 | B (27.1) | A | 39.4 | 33.9 | −5.5 | 67.7 | 34.1 | −33.6 | ○ | ○ |
| Example 3 | C (28.2) | A | 38.6 | 33.9 | −4.7 | 67.9 | 34.1 | −33.8 | ○ | ○ |
| Example 4 | D (27.9) | A | 34.1 | 33.9 | −0.2 | 63.2 | 34.1 | −29.1 | ○ | X |
| Example 5 | A (30.6) | B | 40.9 | 41.5 | 0.6 | 71.3 | 44.6 | −26.7 | ○ | ○ |
| Example 6 | B (27.1) | B | 39.4 | 41.5 | 2.1 | 67.7 | 44.6 | −23.1 | ○ | ○ |
| Example 7 | C (28.2) | B | 38.6 | 41.5 | 2.9 | 67.9 | 44.6 | −23.3 | ○ | ○ |
| Comparative Example 1 | E (0.9) | A | 28.4 | 33.9 | 5.5 | 30.9 | 34.1 | 3.2 | X | X |
| Comparative Example 2 | F (30.6) | C | 31.0 | 36.6 | 5.6 | 63.7 | 38.1 | −25.6 | X | X |
| Comparative Example 3 | G (0.1) | A | 27.5 | 33.9 | 6.4 | 25.3 | 34.1 | 8.8 | X | X |
| Comparative Example 4 | H (1.1) | A | 27.1 | 33.9 | 6.8 | 29.9 | 34.1 | 4.2 | X | X |
| Comparative Example 5 | I (31.4) | C | 29.8 | 36.6 | 6.8 | 64.2 | 38.1 | −26.1 | X | X |
| Comparative Example 6 | D (27.9) | B | 34.1 | 41.5 | 7.4 | 63.2 | 44.6 | −18.6 | X | X |
| Comparative Example 7 | J (2.1) | A | 25.9 | 33.9 | 8 | 31.9 | 34.1 | 2.2 | X | X |
| Comparative Example 8 | E (0.9) | B | 28.4 | 41.5 | 13.1 | 30.9 | 44.6 | 13.7 | X | X |
| Comparative Example 9 | G (0.1) | B | 27.5 | 41.5 | 14 | 25.3 | 44.6 | 19.3 | X | X |

TABLE 1-continued

| Example/ Comparative Example | Kind of transfer belt (γsh(itm); mN/m) | Kind of photosensitive member | γ sd(mN/m) γ sd(itm) | γ sd(pc) | Δ γ sd | γ s(mN/m) γ s(itm) | γ s(pc) | Δ γ s | Hollow defects | Cleaning efficiency |
|---|---|---|---|---|---|---|---|---|---|---|
| Comparative Example 10 | H (0.1) | B | 27.1 | 41.5 | 14.4 | 29.9 | 44.6 | 14.7 | X | X |
| Comparative Example 11 | J (2.1) | B | 25.9 | 41.5 | 15.6 | 31.9 | 44.6 | 12.7 | X | X |

What is claimed is:

1. An image-forming apparatus, comprising an intermediate transfer member having a hard release layer on the surface that receives a primarily transferred toner image from a latent image-supporting member on the hard release layer and secondarily transfers the toner image to an image-receiving medium, wherein, when the difference Δγsd between the dispersion-force component of surface free energy of the intermediate transfer member surface γsd(itm) and the dispersion-force component of surface free energy of the latent image-supporting member surface γsd(pc) is defined by the following Formula:

$$\Delta\gamma sd=\gamma sd(pc)-\gamma sd(itm),$$

Δγsd is 5 mN/m or less.

2. The image-forming apparatus according to claim 1, wherein the dispersion-force component of surface free energy of the intermediate transfer member surface γsd(itm) is 37 mN/m or more.

3. The image-forming apparatus according to claim 1, wherein the hard release layer is an inorganic oxide layer or a hard carbon-containing layer.

4. The image-forming apparatus according to claim 1, wherein the hard release layer is an inorganic oxide layer, and the inorganic oxide is selected from the group of SiO2, Al2O3, ZrO2, TiO2, and a mixture thereof.

5. The image-forming apparatus according to claim 1, wherein the hard release layer is an inorganic oxide layer, and the inorganic oxide is SiO2.

6. The image-forming apparatus according to claim 1, wherein the hard release layer is a hard carbon-containing layer, and the hard carbon-containing layer is selected from the group consisting of amorphous carbon film, hydrogenated amorphous carbon film, tetrahedral amorphous carbon film, nitrogen-containing amorphous carbon film, and metal-containing amorphous carbon film.

7. The image-forming apparatus according to claim 1, wherein the dispersion-force component of surface free energy of the latent image-supporting member surface γsd (pc) is in the range between 32 and 42 mN/m.

8. The image-forming apparatus according to claim 1, wherein the toner has an average particle size of 4.5 to 6.5 μm and an average circularity of 0.960 to 0.980.

9. The image-forming apparatus according to claim 1, wherein the intermediate transfer member has a seamless belt shape.

10. The image-forming apparatus according to claim 1, wherein Δγsd is in the range of −15 to 5 mN/m.

11. The image-forming apparatus according to claim 2, wherein γsd(itm) is in the range of 37 to 45 mN/m.

12. The image-forming apparatus according to claim 1, wherein the hydrogen-bonding component in surface free energy of the intermediate transfer member surface γsh(itm) is in the range of 25-35 mN/m.

13. The image-forming apparatus according to claim 2, wherein the intermediate transfer member has a seamless belt shape.

14. The image-forming apparatus according to claim 3, wherein the intermediate transfer member has a seamless belt shape.

15. The image-forming apparatus according to claim 4, wherein the intermediate transfer member has a seamless belt shape.

16. The image-forming apparatus according to claim 5, wherein the intermediate transfer member has a seamless belt shape.

17. The image-forming apparatus according to claim 6, wherein the intermediate transfer member has a seamless belt shape.

18. The image-forming apparatus according to claim 7, wherein the intermediate transfer member has a seamless belt shape.

19. The image-forming apparatus according to claim 8, wherein the intermediate transfer member has a seamless belt shape.

* * * * *